US007720246B2

(12) United States Patent
Wang et al.

(10) Patent No.: US 7,720,246 B2
(45) Date of Patent: May 18, 2010

(54) HEADPHONE DEVICE

(75) Inventors: Han-Kai Wang, Taipei (TW); Kris Verstockt, Taipei (TW); Chen-Han Sung, Taipei (TW)

(73) Assignee: Primax Electronics Ltd., Taipei (TW)

( * ) Notice: Subject to any disclaimer, the term of this patent is extended or adjusted under 35 U.S.C. 154(b) by 973 days.

(21) Appl. No.: 11/458,272

(22) Filed: Jul. 18, 2006

(65) Prior Publication Data

US 2007/0154051 A1 Jul. 5, 2007

(30) Foreign Application Priority Data

Dec. 29, 2005 (TW) ..... 94147135 A

(51) Int. Cl.
*H04R 25/00* (2006.01)

(52) U.S. Cl. ..... 381/383; 381/378; 381/370

(58) Field of Classification Search ..... 381/370, 381/374, 379, 383
See application file for complete search history.

(56) References Cited

U.S. PATENT DOCUMENTS

2003/0169896 A1* 9/2003 Kirk et al. ..... 381/370

* cited by examiner

*Primary Examiner*—Brian Ensey
(74) *Attorney, Agent, or Firm*—Apex Juris, PLLC; Tracy M Heims

(57) ABSTRACT

A headphone device includes a sound amplifying member, a connecting member and a fixing member. The sound amplifying member includes a first speaker and a second speaker for outputting a sound. The connecting member is interconnected between the first speaker and the second speaker and made of first flexible material. The connecting member is flexibly wound around the first speaker and the second speaker. The fixing member is coupled to the sound amplifying member for securing the connecting member thereon after the connecting member is wound around the first speaker and the second speaker.

5 Claims, 5 Drawing Sheets

HEADPHONE DEVICE

FIELD OF THE INVENTION

The present invention relates to a headphone device, and more particularly to a headphone device having a flexible headband.

BACKGROUND OF THE INVENTION

Nowadays, portable media players such as portable CD players, MP3 players and the like become popular in modern societies due to some advantages such as small size, light weightiness and easy portability. On account of their portability, the users can use such portable media players everywhere they are. In order to hear songs from the portable media player, some accessories such as earphones are indispensable. Since the structure of the earphones may influence the tone quality and the portability of the portable media player, it is important to select suitable earphones matching the portable media player.

Generally, the earphone devices offered by the manufacturers of the portable CD players or the MP3 players are plain earplug types, which have plain sound isolation and plain tone quality. When this earplug type earphone device is used, the volume of the portable CD player or the MP3 player is unconsciously turned up to a high level because the noisy sounds in the surroundings are not effectively isolated. After exposure to such a noisy environment for a long term, the user is readily suffered from hearing loss. For a purpose of protecting from hearing loss, a headphone device having ear muffs is additionally purchased. The headphone device is usually divided into two categories: a vertical headphone device that arches over the head and a horizontal headphone device that rests on the ears. The vertical headphone device that arches over the head is both bulky and cumbersome for the portable use in the portable CD player or the MP3 player. Whereas, the horizontal headphone device that rests on the ears includes a pair of supporting members for supporting the speaker units. According the user's demand, the horizontal headphone device is attached to the rear head of a user as the supporting members rest on the ears. Typically, the vertical headphone device that arches over the head has a rigid hoop structure, and is therefore not feasible for portability or storage. Whereas, the horizontal headphone device that rests on the ears is advantageous for portability or storage because no rigid hoop structure is used. In comparison with the earplug type earphone device, however, the horizontal headphone device is unsatisfactory in portability or storage because the overall volume of the horizontal headphone device is increased and the two speaker units are distant from each other.

For a purpose of solving the drawbacks described above, as shown in FIG. 1(*a*), an improved headphone device is disclosed in U.S. Pat. No. 6,385,325 B1, which is hereby fully incorporated by reference. Referring to FIG. 1(*a*), the headphone device 1 comprises a rigid hoop structure 11, a first supporting member 12, a second supporting member 13, a first speaker unit 14 and a second speaker unit 15. The hoop structure 11 is rotatable about a first fulcrum portion 111 in the direction indicated by the arrow A. The first supporting member 12 and the second supporting member 13 are coupled with the hoop structure 11. When the headphone device 1 is attached to the rear head of a user, the first supporting member 12 and the second supporting member 13 rest on the user's ears. The first speaker unit 14 and the second speaker unit 15 are supported by the first supporting member 12 and the second supporting member 13, respectively. The first supporting member 12 and the second supporting member 13 are rotatable about a second fulcrum portion 121 and a third fulcrum portion 131, respectively, in the direction indicated by the arrow B. For collapsing the headphone device 1, the first fulcrum portion 111 of the hoop structure 11, the second fulcrum portion 121 of the first supporting member 12 and the third fulcrum portion 131 of the second supporting member 13 are cooperatively operated. First of all, as shown in FIG. 1(*b*), the first supporting member 12 and the second supporting member 13 are rotated in the direction indicated by the arrow B about the second fulcrum portion 121 and the third fulcrum portion 131, respectively, so that the first speaker unit 14 and the second speaker unit 15 along with the supporting member 12 and the second supporting member 13 approach toward the hoop structure 11. Then, the hoop structure 11 is rotated in the direction indicated by the arrow A, so that the first speaker unit 14 and the second speaker unit 15 approach each other. Afterwards, the first speaker unit 14 and the second speaker unit 15 are housed in a region surrounded by the first supporting member 12, the second supporting member 13 and the hoop structure 11, as can be seen in FIG. 1(*c*).

Although the headphone device of FIG. 1 is storable when collapsed to a compact size, this headphone device still has some drawbacks. For example, since the hoop structure 11 is made of rigid material, the compact size is not satisfied. As shown in FIG. 1(*c*), due to the rigid hoop structure 11, there is still large space between the first speaker unit 14 and the second speaker unit 15. Therefore, there is a need to collapse the headphone device to a reduced size. In addition, the first fulcrum portion 111, the second fulcrum portion 121 and the third fulcrum portion 131 are readily loosened after many rotating and collapsing cycles. Under this circumstance, the headphone device fails to be well collapsed.

In views of the above-described disadvantages resulted from the prior art, the applicant keeps on carving unflaggingly to develop a headphone device according to the present invention through wholehearted experience and research.

SUMMARY OF THE INVENTION

It is an object of the present invention to provide a headphone device capable of being collapsed to the possible minimum compact size.

In accordance to an aspect of the present invention, there is provided a headphone device. The headphone device comprises a sound amplifying member, a connecting member and a fixing member. The sound amplifying member includes a first speaker and a second speaker for outputting a sound. The connecting member is interconnected between the first speaker and the second speaker and made of first flexible material. The connecting member is flexibly wound around the first speaker and the second speaker according to the shapes of the first speaker and the second speaker. The fixing member is coupled to the sound amplifying member for securing the connecting member thereon after the connecting member is wound around the first speaker and the second speaker.

In an embodiment, the first speaker and the second speaker of the sound amplifying member are disc-shaped.

In an embodiment, the connecting member includes a flexible plastic tube to be wound around the peripheries of the first speaker and the second speaker.

In an embodiment, the connecting member further includes first and second supporting members made of second flexible material, wherein the second flexible material is more rigid than the first flexible material.

In an embodiment, the fixing member comprises first and second fixing parts, which are made of elastic rubber material, have indentation structures and are respectively coupled to the first and second speakers. The connecting member is secured within the indentation structures of the first and second fixing parts after being wound around the peripheries of the first and second speakers.

The above objects and advantages of the present invention will become more readily apparent to those ordinarily skilled in the art after reviewing the following detailed description and accompanying drawings, in which:

BRIEF DESCRIPTION OF THE DRAWINGS

FIG. 1(*b*) is a schematic view illustrating the mechanism for collapsing the headphone device of FIG. 1(*a*);

FIG. 1(*c*) is a schematic view illustrating the headphone device of FIG. 1(*a*) in the collapsed state;

FIG. 2(*b*) is a schematic view illustrating the connecting member of the headphone device shown in FIG. 2(*a*);

FIG. 2(*c*) is a schematic view illustrating the fixing member of the headphone device shown in FIG. 2(*a*);

FIG. 3(*b*) is a schematic view illustrating the headphone device of FIG. 2(*a*) in the collapsed state.

DETAILED DESCRIPTION OF THE PREFERRED EMBODIMENT

Figure 1A:
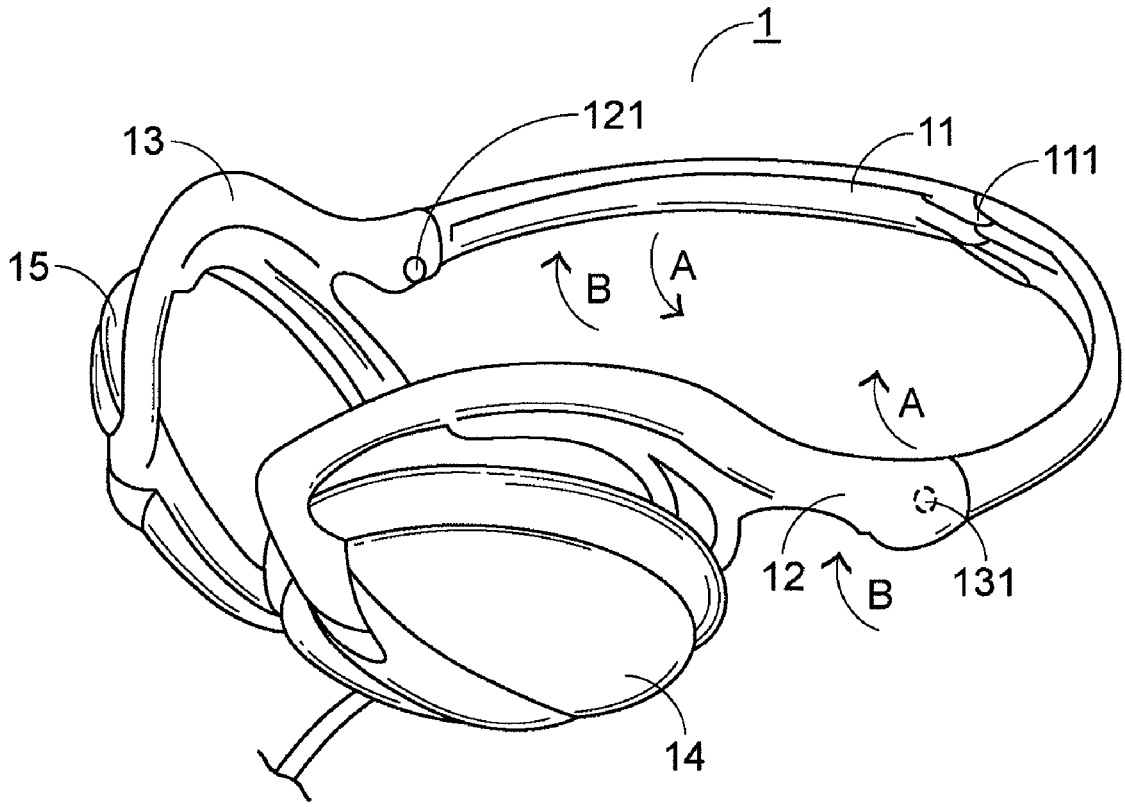
Fig.1(a) PRIOR ART
FIG. 1(*a*) is a schematic perspective view of a conventional headphone device.
Figure 1B:
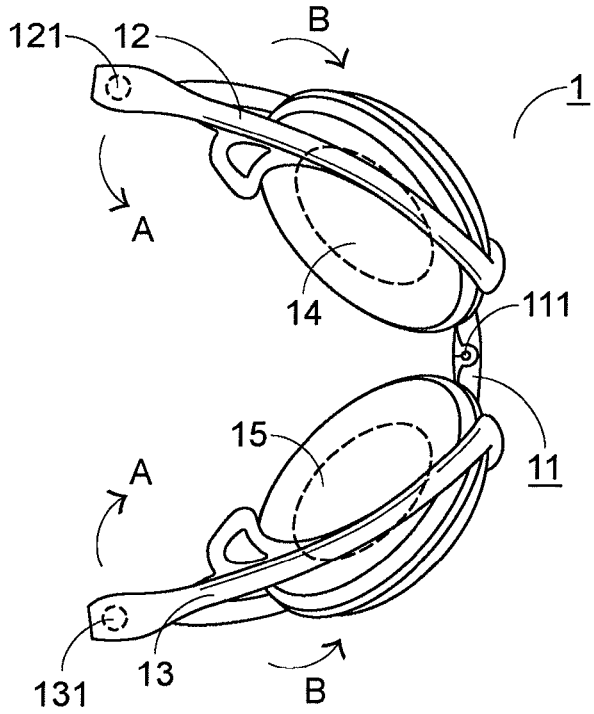
Fig.1(b) PRIOR ART
Figure 1C:
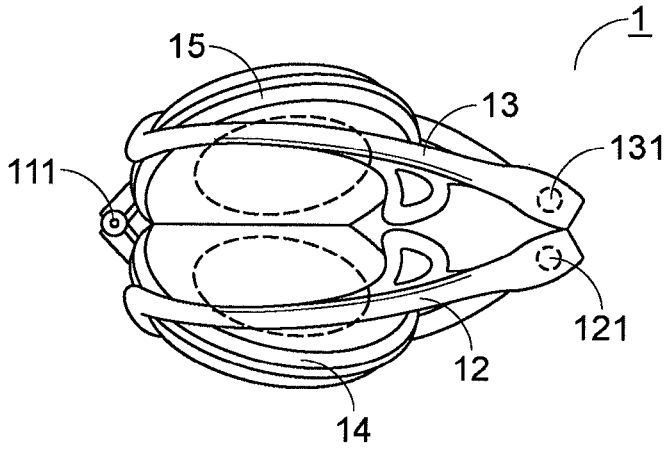
Fig.1(c) PRIOR ART
Figure 2A:
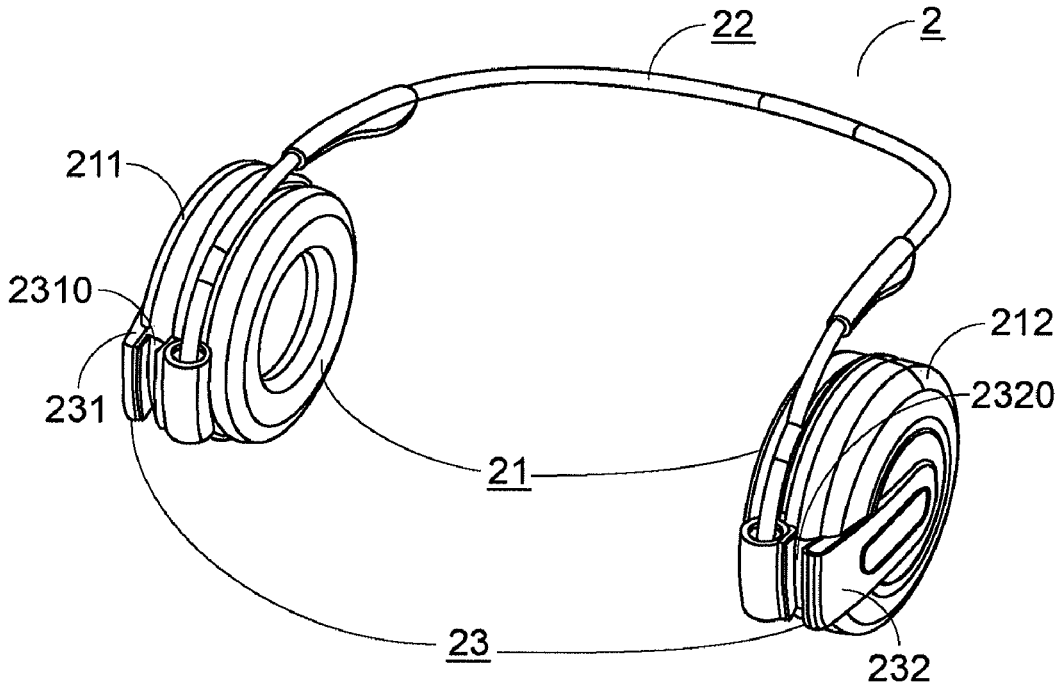
FIG. 2(*a*) is a schematic perspective view of a headphone device according to a preferred embodiment of the present invention.
Figure 2B:
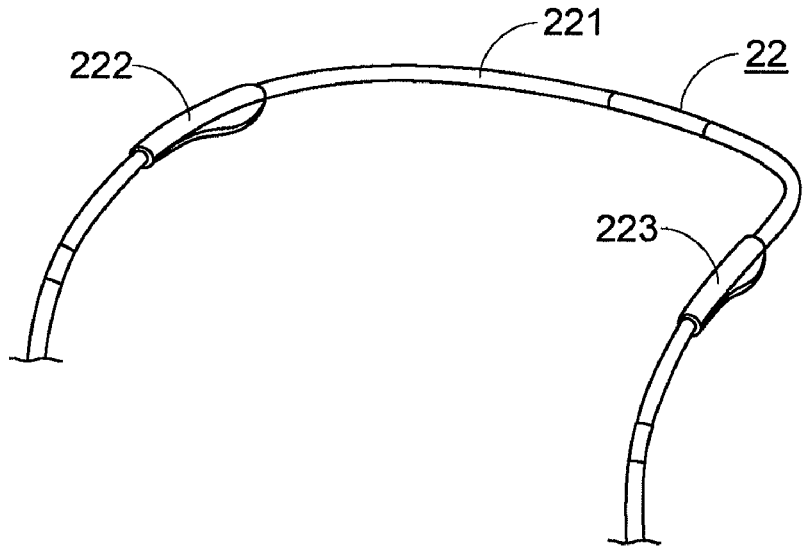
Figure 2C:
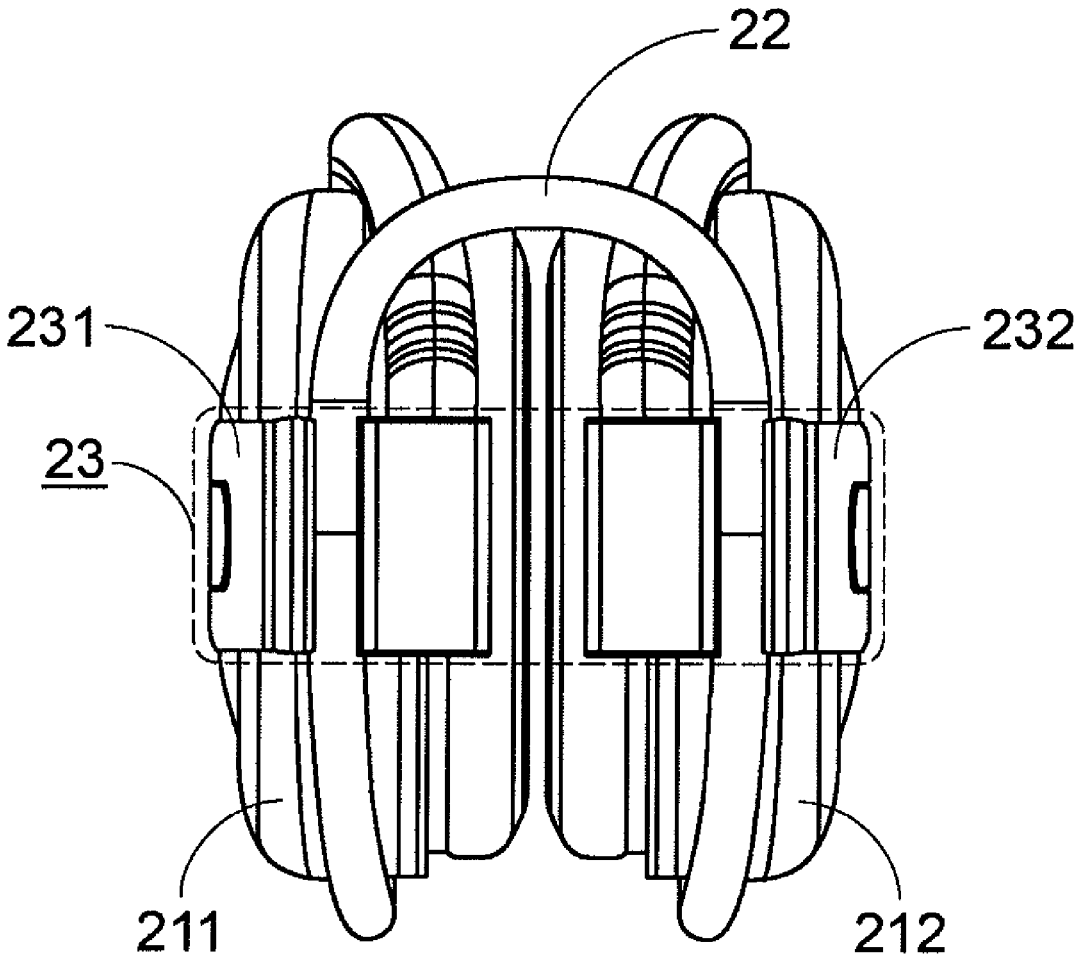

Referring to FIG. 2(*a*), a schematic perspective view of a headphone device according to a preferred embodiment of the present invention is illustrated. In this embodiment, the headphone device is a wireless headphone device. As shown in FIG. 2(*a*), the wireless headphone device 2 principally comprises a sound amplifying member 21, a connecting member 22 and a fixing member 23. The sound amplifying member comprises a first speaker 211 and a second speaker 212, which are disc-shaped. Via the first speaker 211 and the second speaker 212, the user can hear songs from the portable media player. In addition, each of the first speaker 211 and the second speaker 212 further comprises a wireless signal receiver (not shown) for receiving wireless signals from the portable media player. The wireless signals are converted into the sound signals to be outputted through the sound amplifying member 21.

In accordance with the major features, the connecting member 22 and the fixing member 23 of the headphone device 2 are cooperated with each other to perform a satisfactory collapsing operation. The connecting member 22 is made of flexible material and coupled to the first speaker 211 and the second speaker 212. Due to the flexible property, the connecting member 22 is deformed when an external force is applied thereon, to be wound around the peripheries of the first speaker 211 and the second speaker 212. The fixing member 23 is coupled to the sound amplifying member 21. After the connecting member 22 is wound around the peripheries of the first speaker 211 and the second speaker 212, the connecting member 22 is clamped by the fixing member 23, so that the connecting member 22 is secured onto the sound amplifying member 21. Meanwhile, the wireless headphone device 2 is collapsed to a possible minimum compact size.

Please refer to FIG. 2(*b*). The connecting member 22 of the wireless headphone device 2 includes a flexible tube 221, which is made of a flexible plastic material such as silicon. As previously described, the conventional headphone device needs additional fulcrum portions for collapsing the hoop structure because the rigid hoop structure is made of rigid material. Due to the flexible property, the connecting member 22 is deformed to be wound around the peripheries of the first speaker 211 and the second speaker 212. In addition, a power cable (not shown) is accommodated within the flexible tube 221 for electrically connecting the first speaker 211 and the second speaker 212, so as to transmit electrical signals between the first speaker 211 and the second speaker 212. The connecting member 22 further includes a first supporting member 222 and a second supporting member 223, which are made of elastic rubber material and coupled with the first speaker 211 and the second speaker 212, respectively. Since the first supporting member 222 and the second supporting member 223 are more rigid than the flexible tube 221, the first speaker 211 and the second speaker 212 are respectively supported by the first supporting member 222 and the second supporting member 223. When the wireless headphone device 2 is attached to the rear head of a user, the first supporting member 222 and the second supporting member 223 may rest on the user's ears.

Referring to FIG. 2(*a*) and FIG. 2(*c*), the detailed structure of the fixing member 23 of the wireless headphone device 2 is illustrated. The fixing member 23 includes a first fixing part 231 and a second fixing part 232 coupled to the first speaker 211 and the second speaker 212, respectively. As shown in FIG. 2(*a*), the first fixing part 231 and the second fixing part 232 have respective indentation structures 2310 and 2320 for facilitating the user to secure the connecting member 22 therein. For example, after the connecting member 22 is wound around the peripheries of the first speaker 211 and the second speaker 212, the connecting member 22 should be accommodated within and clamped by the indentation structures 2310 and 2320 of the first fixing parts 231 and the second fixing parts 232, respectively. Under this circumstance, the wireless headphone device 2 is collapsed to the possible minimum compact size.

From the above description, the present invention is capable of collapsing the wireless headphone device to the possible minimum compact size on account of the flexible connecting member 22 and the fixing mechanism of the fixing member 23. The connecting member 22 is firstly wound around the peripheries of the first speaker 211 and the second speaker 212, and then the connecting member 22 is clamped by the indentation structures of the fixing member 23.

Figure 3A:
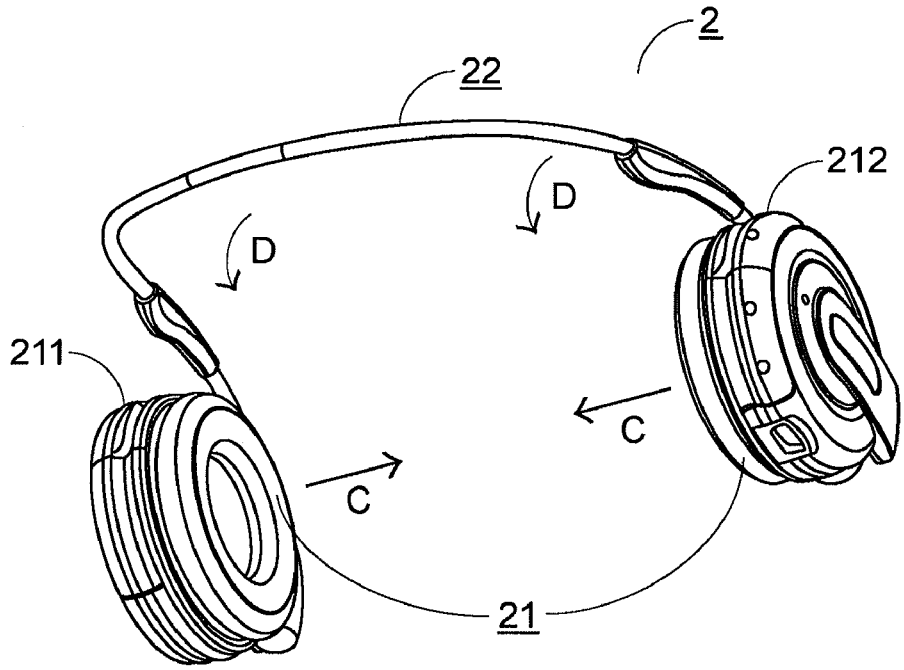
FIG. 3(*a*) is a schematic view illustrating the mechanism for collapsing the headphone device of FIG. 2(*a*)
Figure 3B:
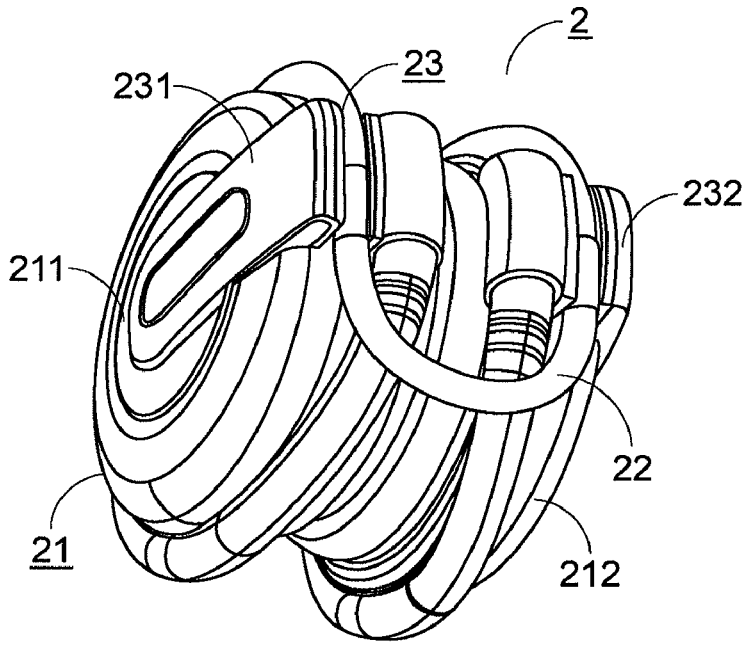

Please refer to FIGS. 3(*a*) and 3(*b*), which illustrate the process for collapsing the wireless headphone device 2. First of all, as shown in FIG. 3(*a*), the first speaker 211 and the second speaker 212 of the sound amplifying member 21 are pushed toward each other in the direction indicated by the arrow C. Then, the connecting member 22 is bent toward the sound amplifying member 21 in the direction indicated by the arrow D and then wound around the peripheries of the first speaker 211 and the second speaker 212. Afterward, the connecting member 22 is clamped by the first fixing part 231 and the second fixing part 232. Under this circumstance, the wireless headphone device 2 is collapsed to the possible minimum compact size as can be seen in FIG. 3(*b*).

From the above description, by winding the connecting member around the peripheries of the sound amplifying member and then securing the connecting member onto the fixing member, the wireless headphone device can be collapsed to the possible minimum compact size. In addition, due to the flexibility, the problems occurred in the prior art of using fulcrum portions to collapse the headphone will be overcome.

The present invention is illustrated by referring to a wireless headphone device. Nevertheless, the present invention can be extended to the technology of storing the wired headphone device.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A headphone device comprising:

a sound amplifying member including a first speaker and a second speaker for outputting a sound;

a connecting member interconnected between said first speaker and said second speaker and made of first flexible material, said connecting member being flexibly wound around said first speaker and said second speaker according to the shapes of said first speaker and said second speaker; and a fixing member coupled to said sound amplifying member for securing said connecting member thereon after said connecting member is wound around said first speaker and said second speaker.

2. The headphone device according to claim 1 wherein said first speaker and said second speaker of said sound amplifying member are disc-shaped.

3. The headphone device according to claim 1 wherein said connecting member includes a flexible plastic tube to be wound around the peripheries of said first speaker and said second speaker.

4. The headphone device according to claim 1 wherein said connecting member further includes first and second supporting members made of second flexible material, wherein said second flexible material is more rigid than said first flexible material.

5. The headphone device according to claim 1 wherein said fixing member comprises first and second fixing parts, which are made of elastic rubber material, have indentation structures and are respectively coupled to said first and second speakers, wherein said connecting member is secured within said indentation structures of said first and second fixing parts after being wound around the peripheries of said first and second speakers.

* * * * *